US005487541A

United States Patent [19]

Dictor

[11] Patent Number: 5,487,541

[45] Date of Patent: Jan. 30, 1996

[54] PING PONG TABLE COVER

[76] Inventor: Ivan S. Dictor, 16 Dione La., Hauppauge, N.Y. 11788

[21] Appl. No.: 262,544

[22] Filed: Jun. 20, 1994

[51] Int. Cl.[6] ..... A63B 67/04

[52] U.S. Cl. ..... 273/30; 473/34; 273/29 R

[58] Field of Search ..... 273/29 R, 30; 473/1, 34

[56] References Cited

U.S. PATENT DOCUMENTS

| | | | |
|---|---|---|---|
| 368,531 | 8/1878 | Hubbell et al. | 473/34 |
| 816,568 | 4/1906 | Dirand | 473/34 |
| 847,246 | 3/1907 | Dirand | 473/34 |
| 971,222 | 9/1910 | Stivers | 473/34 |
| 974,721 | 11/1910 | Stivers | 473/34 |
| 1,482,314 | 1/1924 | Murphy | 473/34 |
| 1,933,917 | 11/1933 | Mattsen | 473/34 |

*Primary Examiner*—Theatrice Brown

[57] ABSTRACT

A cover for a regulation size ping pong table in which from helical turns about a centrally located support shaft the two ends of the cover are payed out in opposite directions for attachment to cooperating opposite ends of the table to protect the playing area beneath the cover from weather elements, and wherein the length of the cover is of similar ping pong table regulation size so that it is in a taut condition, i.e. devoid of excess size, to better promote gravity flow of rain therefrom as well as to provide resistance to wind gusts, and to have other utilitarian features.

5 Claims, 2 Drawing Sheets

PING PONG TABLE COVER

The present invention relates generally to fabric-type weather barriers or covers for articles used outdoors, and more particularly to improvements in a cover for a ping-pong table which obviates the need to remove the table from a preferred outdoor patio location and effectively prevents weather damage to the table, as might result from rain, wind gusts and the like.

Examples of the Prior Art

Articles having draped thereabout covers of appropriate weather-barrier construction material are already well known as exemplified by U.S. Pat. No. 1,918,423 for "Automobile Cover Apparatus" issued to N. L. Persinger on Jul. 18, 1933, in which the cover is held in its in-use draped condition by cords, and by U.S. Pat. No. 2,646,097 for "Automobile Cover" issued to D. R. Gaverth et al. on Jul. 21, 1953, which uses cords under spring urgency to batten down the cover in its draped condition over the automobile.

In the above, and all other known prior art weather barrier covers for outdoor articles, such as cars or the like, wind gusts require techniques for holding the cover in place so the cover water impervious construction material can protect the car against rain or snow and achieve the purposes intended.

Broadly, it is an object of the present invention to provide a cover, specifically for a ping-pong table, overcoming the foregoing and other shortcomings of the prior art.

More particularly, it is an object to embody the within inventive cover in its ping-pong covering operative position with tautness that assures the cover of staying in place without extra or additional tie-down means, all as will be better understood as the description proceeds.

Underlying the present invention is the recognition that the regulation table size and shape dictated for playing ping-pong can be used to advantage by selecting for the length of a rectangular shaped strip form for the within cover a length that corresponds to said regulation prescribed length of the table. This size relationship imparts tautness to the cover when in use, rather than a loosely draped condition typical of prior art covers, and correspondingly obviates a battening down procedure for the cover.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
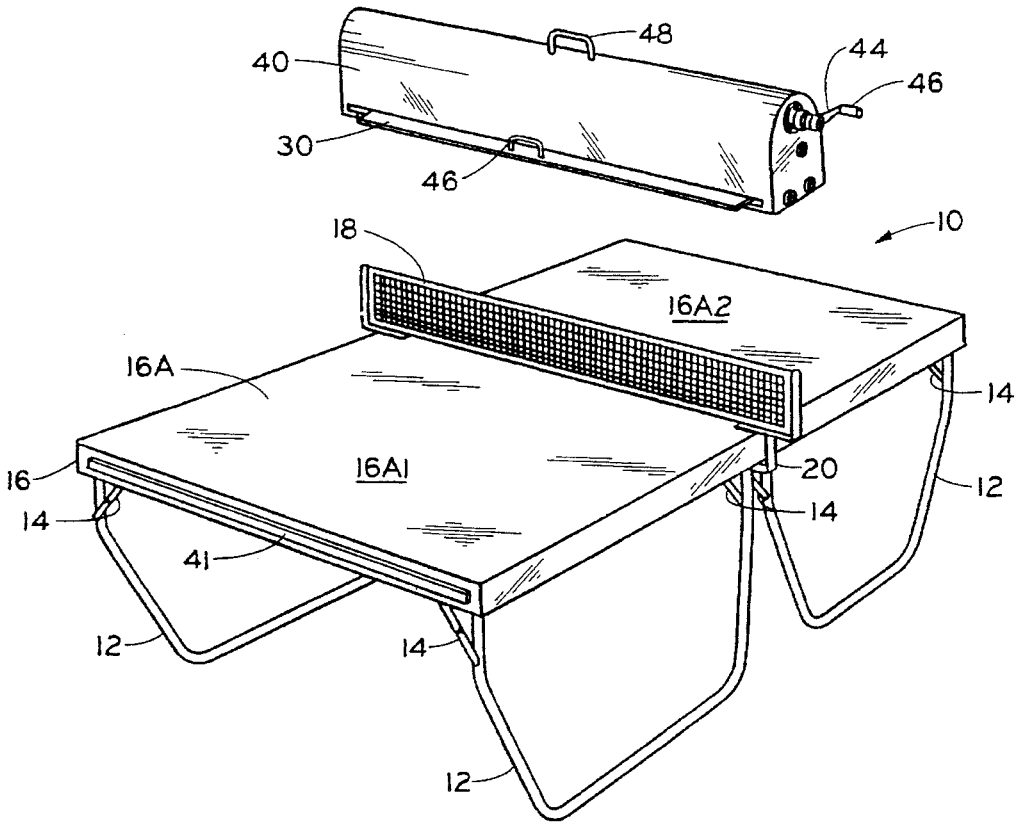
FIG. 1 is a perspective view of a ping-pong table and of a housing containing the within inventive cover preparatory to assembly thereof.
Figure 2:
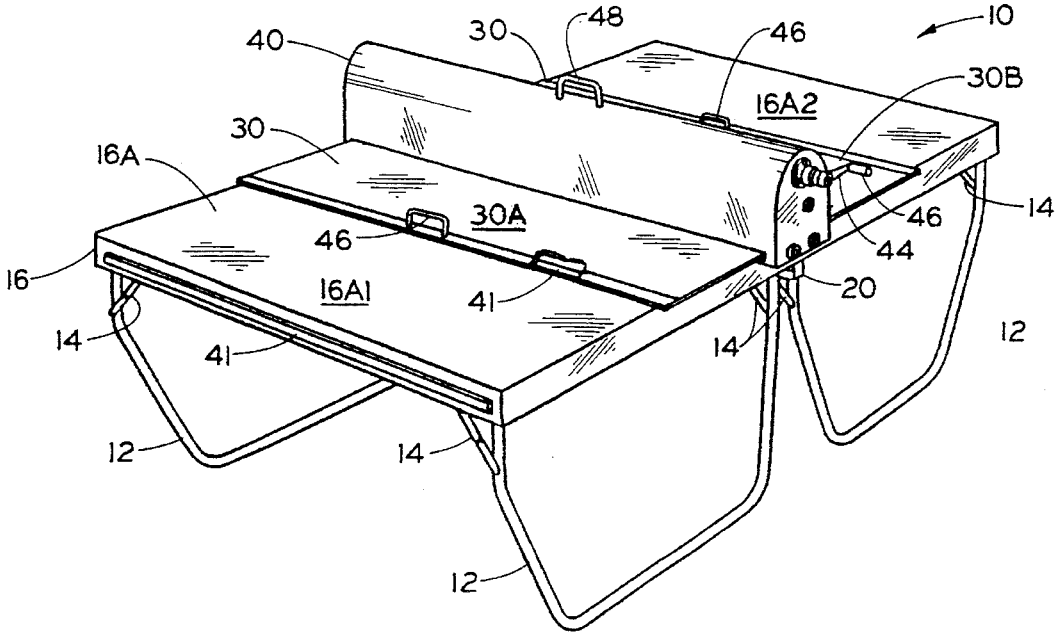
FIG. 2 is a similar perspective view illustrating the assembly and partial payout of the cover.
Figure 4:
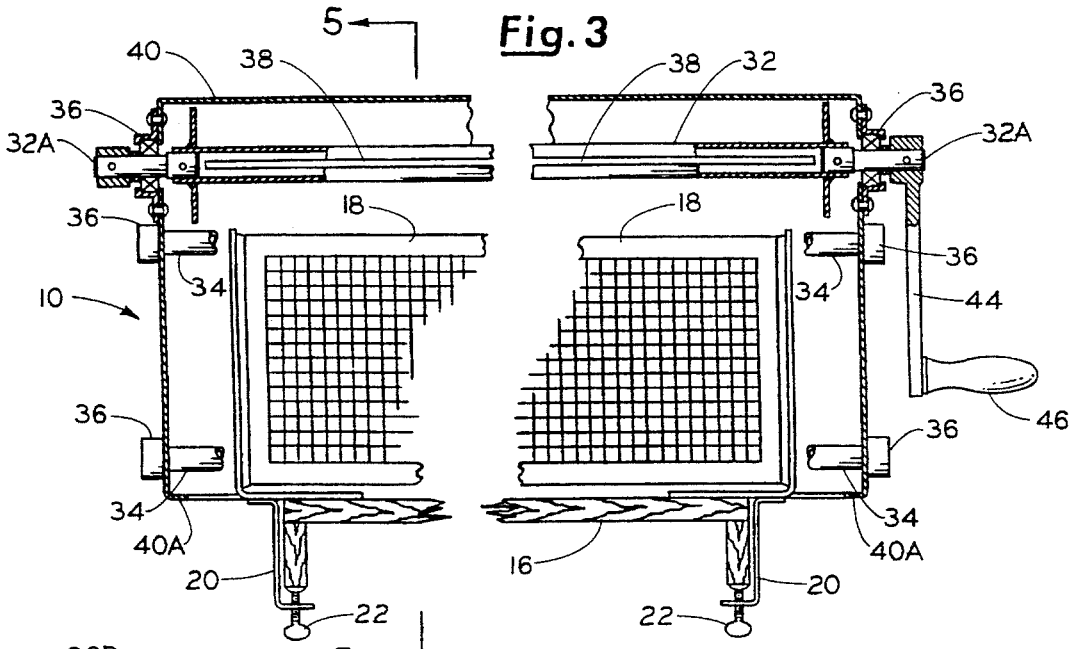
FIG. 4 is a partial sectional view as taken along line 4—4 of FIG. 3.

The game of ping-pong can be aptly characterized as popular family patio recreation in that the ping-pong table, generally designated 10 in FIG. 1, is of known regulation size, i.e. 9 feet in length and 5 feet in width, typically requiring a patio location. As such, when not in use, prior art storage of the table, in order to prevent weather damage thereto, requires that legs, collectively designated 12, have their cooperating hinges 14 released to permit inward folding of these legs beneath the panel construction 16 which, on its upper exposed surface, correspondingly provides the playing surface 16A for the ping-pong game to be played thereon. During this prior art storage procedure for table 10, a net 18 positioned centrally of the length, as illustrated in FIG. 1, and mounted on end clamps 20 in spanning relation widthwise thereof is also typically removed by releasing the clamp screws 22 (FIG. 4 ).

The construction of the ping-pong table 10 as above generally described is well known and specific structural details have thus been omitted as unnecessary. What now follows is a description of the within inventive cover, generally designated 30 in FIG. 3, and the specific structural details heretofore not known which implement the use of the cover 30. Cover 30, in accordance with the present invention, prepares the table 10 when not in use and still in its erect condition so as to be unaffected by weather elements, such as rain, snow and wind gusts.

Figure 3:
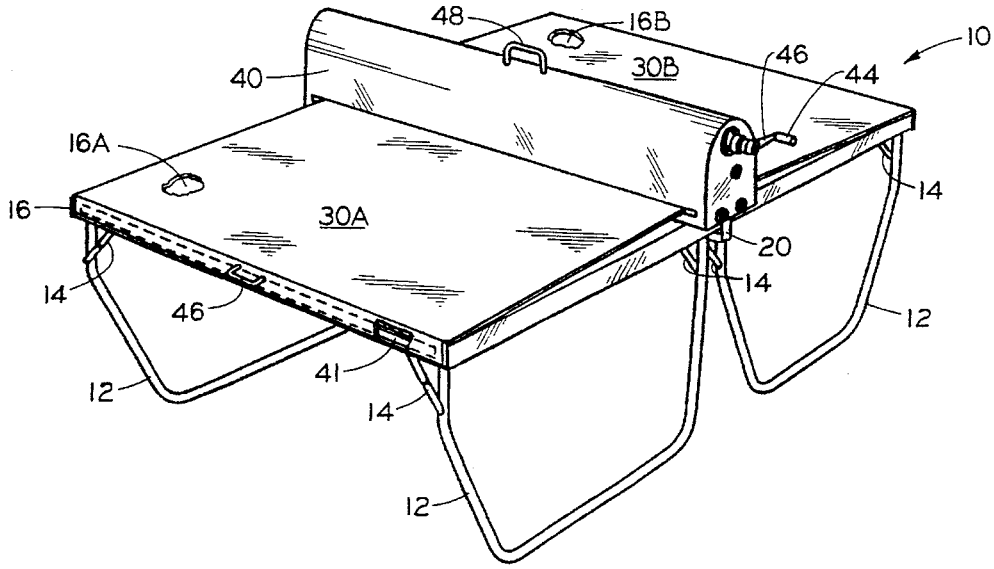
FIG. 3 is still another perspective view illustrating the full payout of the cover over the table.

Cover 30 will be understood to be of appropriate construction material, such as backed vinyl or other plastic or the like, to function effectively as a weather barrier against rain and snow. Wind gusts have heretofore been a problem for article-draped covers of the nature involved, requiring significant battening down techniques. Obviating this prior art shortcoming, however, and underlying the present invention is the recognition that the regulation table 10 size and shape dictated for playing ping-pong can be used to advantage by selecting for the length of a rectangular shaped strip form for cover 30 a length that corresponds to said regulation prescribed length of table 10. As will be better understood as the description proceeds, one half lengths of the cover strip 30 are payed out from a supply roll in opposite directions from a location above the net 18 in spanning relation to an attachment at a cooperating end of the table 10 with, of course, the cooperating half playing surfaces 16A1 and 16A2 beneath said half cover strips 30A, 30B, all as best illustrated in FIG. 3. In said FIG. 3 payout condition of the half covers 30A, 30B the distance spanned relative to the lengths of these covers is effective to hold these covers taut, and as such it has been found in practice that the covers are not adversely affected by wind gusts of the nature typically encountered.

Figure 5A:
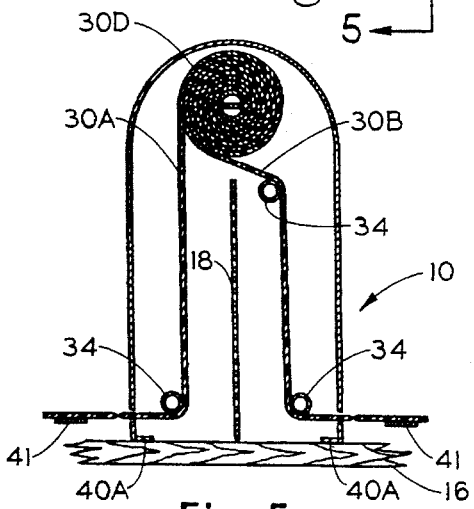
FIGS. 5A and 5B are end sectional views taken along line 5—5 of FIG. 4 illustrating in FIG. 5A the helically interleaved storage condition of the cover, and in FIG. 5B the payout condition thereof providing the table-protecting condition of FIG. 3.
Figure 5B:
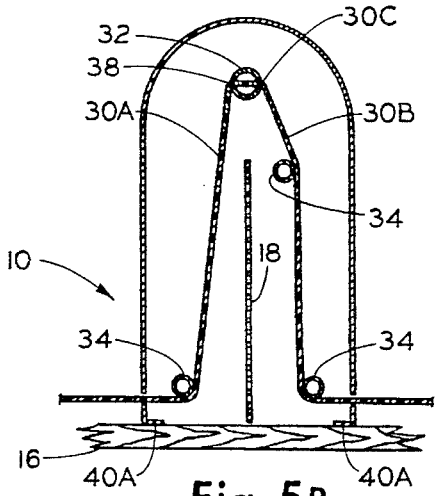

As best shown in FIGS. 5A and 5B, the selected length of cover 30, or its mechanical equivalent of two half lengths 30A and 30B attached appropriately end-to-end to each other, have a compact storage condition as illustrated in FIG. 5A, of, starting at a medial location 30C (FIG. 5B) of strip 30, of interleaved helical turns, designated 30D, about a rotationally journalled support shaft 32 (best illustrated in FIG. 5B). Following counterclockwise rotation of shaft 32, and as best shown in FIG. 5B, the cover halves 30A and 30B are payed out from said shaft, the tracking of such movement being facilitated by rods, individually and collectively designated 34 rotatable in end bearings 36 (FIG. 4) through widthwise oriented slots 38 in an inverted U-shaped housing 40. In a preferred embodiment, there is provided cooperating attaching means, in the form of Velcro strips 41, on the respective free ends of the half covers 30A, 30B and opposite ends of the table 10 to hold the taut covers in the FIG. 3 table-protecting condition. The slots 38 are located slightly above the playing surface 16A so as to impart an angular orientation to the taut covers 30A, 30B which contributes to gravity flow drainage of rain impinging on the covers.

Housing 40, as best shown in FIG. 4, mounts bearings 42 for opposite ends of shaft 32 thus journalling same for rotation in a well understood manner, and has appropriately attached at shaft end 32A a crank 44 for urging shaft 32 in either clockwise rotation for withdrawing the payed out covers 30A, 30B, or in counterclockwise rotation for providing said payed out condition assisted by the user pulling on handles 46. So as not to mar the playing surface 16A opposite sides of the housing 40 terminate in inturned flat edges 40A. For ease of handling and positioning, housing 40 is provided with a carrying handle 48.

From the foregoing description it should be readily appreciated that use of the within inventive cover 30 for protecting the ping-pong table 10 against weather damage is greatly facilitated since the table can remain in its erect condition and, at the option of the user, even in its in-use patio or outdoor location, although if an extended period of non-use is contemplated, the location can be changed to one offering its own protection against the weather.

While the within inventive apparatus herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A cover for a table tennis table having a panel delineating a rectangular substantially horizontal playing surface of a predetermined width and length, and a net positioned centrally of said length and spanning said width, said cover comprising;

a pair of rectangular strips of flexible weather barrier material, each strip having first and second ends and a length greater than one-half the length of said playing surface, and being substantially equal to the width of said playing surface;

an elongated shaft, means for rotatably supporting said shaft in a plane substantially parallel to and above said net;

means on said shaft for rotation thereof;

means connecting said first end of each rectangular strip longitudinally along said shaft, whereby rotation of said shaft in one direction will cause said strips to be wound about said shaft and rotation of said shaft in a direction opposite said one direction will cause said strips to unwound from said shaft for extension of said strips over a cooperating half of said playing surface;

means on said second end of each strip for attaching said second end to cooperating attachment means on said table.

2. A ping-pong table cover as claimed in claim 1 wherein said means supporting said shaft is a removable inverted U-shaped housing for receiving therein said net when placed in covering relation thereover.

3. A cover as defined in claim 1 wherein, said means for attaching said second ends to said table and said cooperating attachment means on said table is one of a hook and loop strip of fastener material for holding said strips in a taut condition.

4. A cover as defined in claim 1 wherein, means defining a handle is attached to said second end of each strip for grasping by a person for manually rotating said shaft in said opposite direction for extending said strips over said playing surface.

5. A cover as defined in claim 1 wherein, a crank is attached to said shaft for rotating said shaft in at lease said one direction to thereby wound said strips about said shaft.

* * * * *